US009929543B2

(12) United States Patent
Katano et al.

(10) Patent No.: US 9,929,543 B2
(45) Date of Patent: Mar. 27, 2018

(54) INTERNAL COMBUSTION ENGINE AND IGNITION COIL

(71) Applicant: IMAGINEERING, INC., Kobe-shi, Hyogo (JP)

(72) Inventors: Hiroki Katano, Kobe (JP); Yuji Ikeda, Kobe (JP)

(73) Assignee: IMAGINEERING, INC., Kobe-shi (JP)

( * ) Notice: Subject to any disclaimer, the term of this patent is extended or adjusted under 35 U.S.C. 154(b) by 263 days.

(21) Appl. No.: 14/822,053

(22) Filed: Aug. 10, 2015

(65) Prior Publication Data

US 2016/0028215 A1 Jan. 28, 2016

Related U.S. Application Data

(63) Continuation of application No. PCT/JP2014/053012, filed on Feb. 10, 2014.

(30) Foreign Application Priority Data

Feb. 8, 2013 (JP) ..... 2013-022847

(51) Int. Cl.
*H01T 15/00* (2006.01)
*F02P 13/00* (2006.01)
(Continued)

(52) U.S. Cl.
CPC ..... *H01T 15/00* (2013.01); *F02P 13/00* (2013.01); *F02P 15/005* (2013.01);
(Continued)

(58) Field of Classification Search
CPC ..... F02P 13/00; F02P 15/00; F02P 15/005; F02P 3/04; F02P 23/045; F02F 1/242; H01T 15/00; H01F 38/12
See application file for complete search history.

(56) References Cited

U.S. PATENT DOCUMENTS 5,421,923 A * 6/1995 Clarke ..... B06B 3/00 156/292
6,005,464 A * 12/1999 Sakamaki ..... F02P 3/02 123/634
(Continued)

FOREIGN PATENT DOCUMENTS

JP 2007-180461 A 7/2007
JP 2010-1827 A 1/2010
JP 2011-159476 A 8/2011

OTHER PUBLICATIONS

International Search Report dated Apr. 22, 2014, issued in counterpart Application No. PCT/JP2014/053012 (1 page).
(Continued)

*Primary Examiner* — Joseph Dallo
*Assistant Examiner* — Anthony L Bacon
(74) *Attorney, Agent, or Firm* — Westerman, Hattori, Daniels & Adrian, LLP

(57) ABSTRACT

The internal combustion engine has an internal combustion engine main body and a substantially columnar ignition coil. A head part at one end of the ignition coil is provided with an electromagnetic wave element for outputting electromagnetic waves irradiated into a combustion chamber of the internal combustion engine main body, and a plurality of supporting components are provided for supporting the ignition coil when an attaching part at the other end of the ignition coil is attached to a spark plug, the supporting components supporting the ignition coil either at or near a nodal point in a characteristic vibration mode of vibration occurring in the ignition coil along with vibration of the internal combustion engine main body. The ignition coil is not supported on the side toward the head part relative to the support member nearest the head part.

10 Claims, 4 Drawing Sheets

(51) Int. Cl.

| | |
|---|---|
| ***F02P 15/00*** | (2006.01) |
| ***H01F 27/28*** | (2006.01) |
| ***H01F 38/12*** | (2006.01) |
| *F02F 1/24* | (2006.01) |

(52) U.S. Cl.
CPC ..... *H01F 27/2823* (2013.01); *H01F 38/12* (2013.01); *F02F 1/242* (2013.01)

(56) References Cited

U.S. PATENT DOCUMENTS

| | | | | |
|---|---|---|---|---|
| 2003/0197584 | A1* | 10/2003 | Ford | H01F 27/29 336/96 |
| 2006/0132271 | A1* | 6/2006 | Takeyama | F02P 3/02 336/90 |
| 2006/0260591 | A1* | 11/2006 | Iwa | F02P 3/02 123/634 |
| 2009/0314239 | A1 | 12/2009 | Idogawa et al. | |

OTHER PUBLICATIONS

English translation of Written Opinion dated Apr. 22, 2014, issued in counterpart Application No. PCT/JP2014/053012 (5 pages).

* cited by examiner

[Fig. 1]
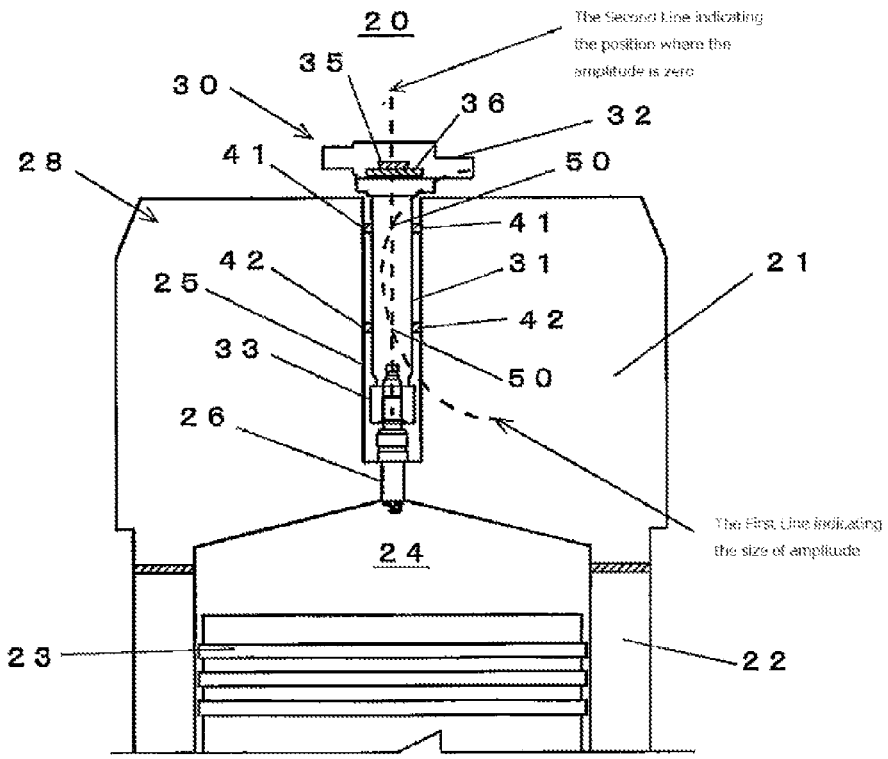
[Fig. 2a]
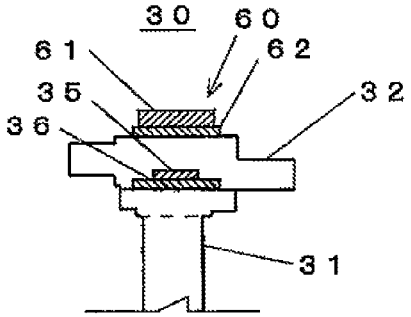
[Fig. 2b]
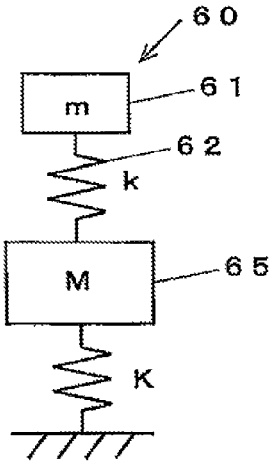

[Fig. 3a]
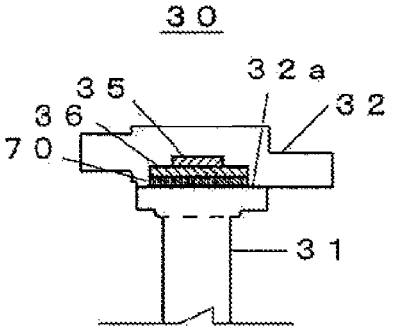
[Fig. 3b]
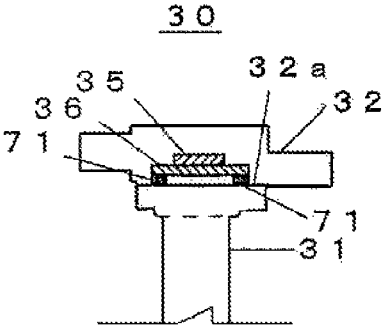
[Fig. 4a]
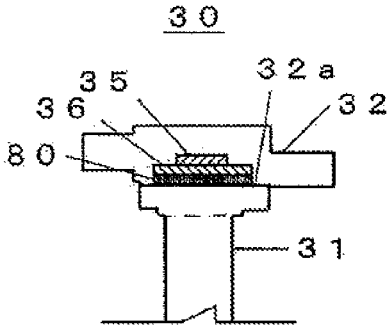
[Fig. 4b]
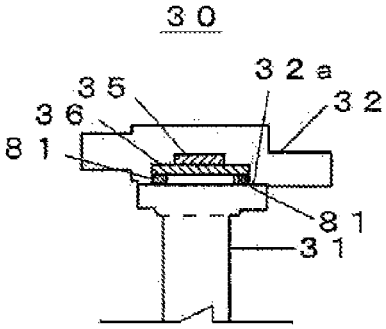
[Fig. 4c]
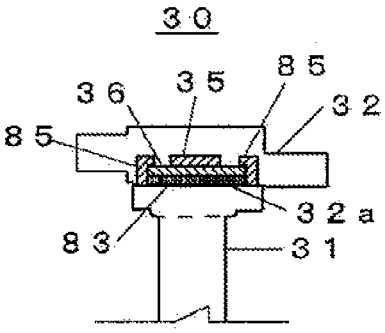

[ Fig. 5]
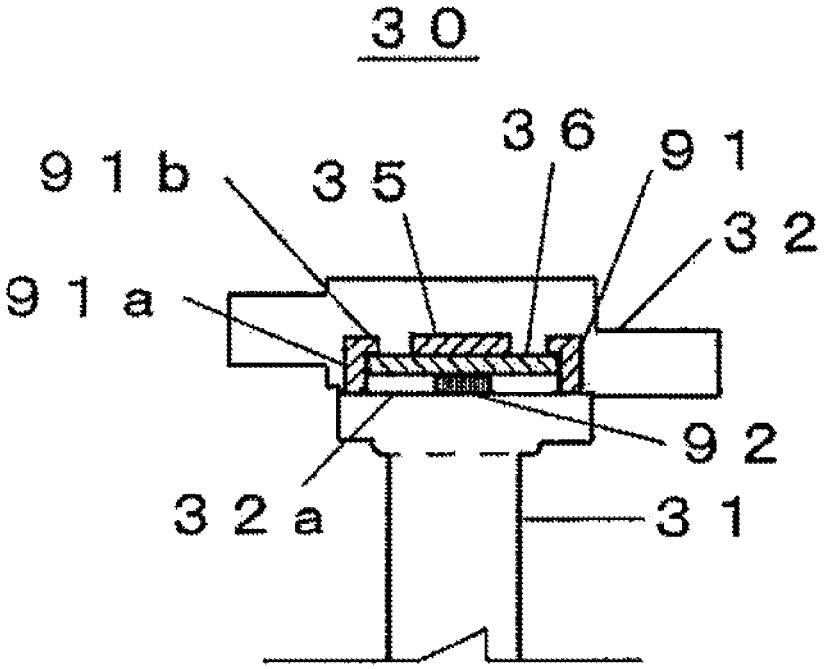

[ Fig. 6]
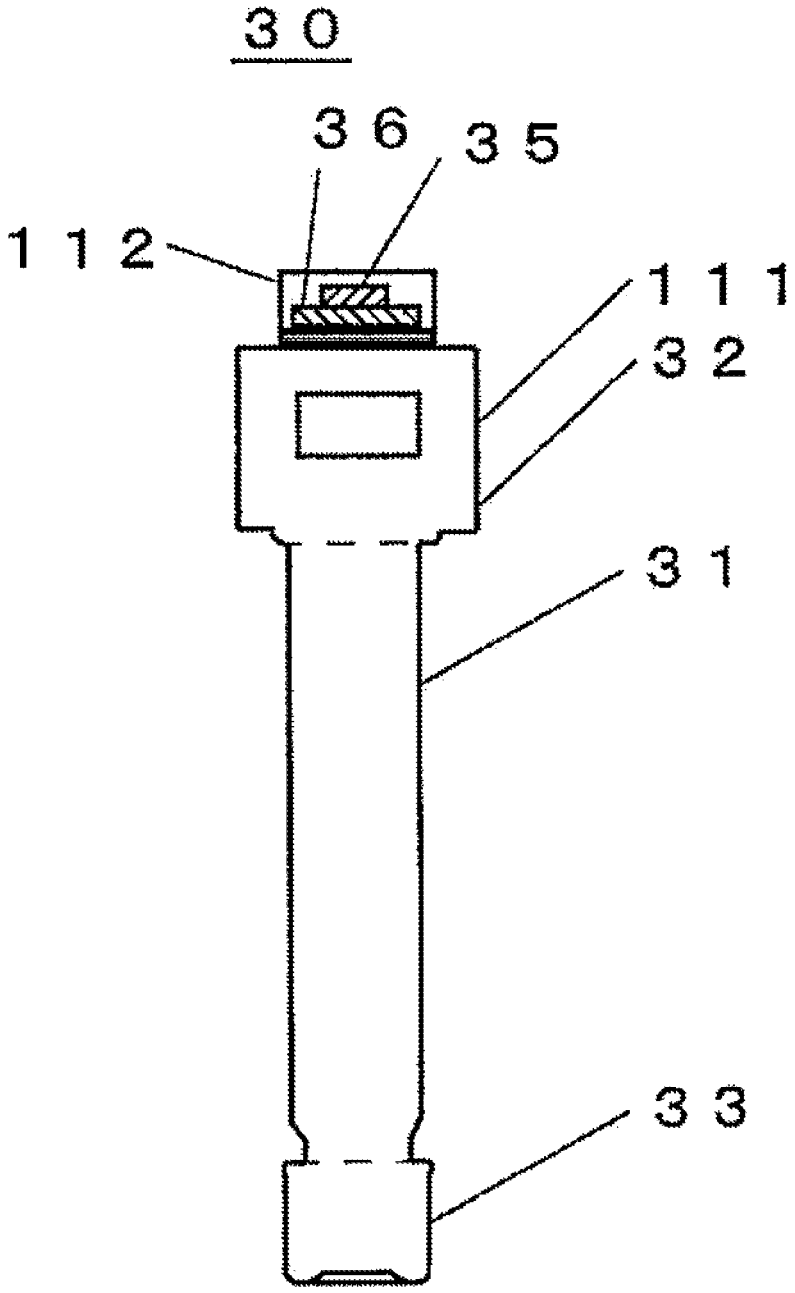

INTERNAL COMBUSTION ENGINE AND IGNITION COIL

TECHNICAL FIELD

The present disclosure relates to an internal combustion engine that includes an ignition coil equipped with an electromagnetic wave element which outputs electromagnetic waves.

BACKGROUND ART

Patent documents 1 discloses an ignition device provided with a microwave oscillation device as an apparatus so called an ignition coil (see FIG. 3). The microwave oscillation device has an amplification element. The head part of the ignition device is provided with a mounting flange (see FIG. 4). The ignition device is fixed to the internal combustion engine main body using an attachment bolt which penetrates the mounting flange.

PRIOR ART DOCUMENTS

Patent Documents

Patent Document 1: JP 2010-001827A

THE DISCLOSURE OF THE INVENTION

Problems to be Solved by the Invention in the conventional ignition coil, vibration of the internal combustion engine easily transmits to the head part because the head part is fixed to the internal combustion engine. Therefore, a strong vibration may occur in the electromagnetic wave element together with the head part when the electromagnetic wave element for outputting the electromagnetic wave and the electric circuit are provided on the head part. This can lead to a malfunction of the electromagnetic wave element because of the deformation of the electromagnetic wave element such as momentary bending deformation or the vibration of the electric circuit In view of above described circumstances, the present disclosure provides an internal combustion engine that can reduce the vibration force acting on the electromagnetic wave element on the head part of the ignition coil.

Means for Solving the Problems

An internal combustion engine according to the present disclosure includes an internal combustion engine main body forming a plughole therein; and a pillar shaped ignition coil to be inserted in the plughole. An electromagnetic wave element is provided on a head part of the one end side of the ignition coil for outputting electromagnetic waves to be emitted to the combustion chamber of the internal combustion engine main body. The internal combustion engine comprises a plurality of supporting components that support the ignition coil at a nodal point of the characteristic vibration mode of vibration that occurs in the ignition coil accompanied by the vibration of the internal combustion engine main body when an attaching part in the other end of the ignition coil is attached to the ignition plug positioned in the combustion chamber side of the plughole.

An ignition coil of the present disclosure is a pillar shaped ignition coil inserted in a plughole of an internal combustion engine. An attaching part of the one end side is attached to the spark plug positioned in the combustion chamber side of the plughole. The ignition coil comprises an electromagnetic wave element that outputs the electromagnetic waves to be emitted to the combustion chamber is provided on the head part of the other and side of the ignition coil, and a dynamic damper attached to the head part or the attaching part.

An ignition coil of the present disclosure is a pillar shaped ignition coil that is inserted in a plughole of an internal combustion engine, and an attaching part in the one end side is attached to the spark plug which is positioned in the combustion chamber side of the plughole. The ignition coil comprises an electromagnetic wave element that is provided on the head part of the other end side of the ignition coil, and that outputs the electromagnetic waves to be emitted to the combustion chamber; a mounting component that mounts the electromagnetic wave element; and a dumping material made of fluid or solid material of low rigidity compared to the mounting component, wherein the dumping material is provided between the mounting component and an installation surface for installing the mounting component in the head part.

An ignition coil of the present disclosure is a pillar shaped ignition coil inserted in a plughole of an internal combustion engine, where an attaching part of the one end side is attached to the spark plug positioned in the combustion chamber side of the plughole. The ignition coil comprises an electromagnetic wave element that outputs the electromagnetic waves to be emitted to the combustion chamber is provided on the head part of the other end side of the ignition coil; a mounting component that mounts the electromagnetic wave element; a holding component that holds the mounting component using a frictional force at the domain contacting with the mounting component, wherein the holding component is a component different from the mounting component. The mounting component is held using a frictional force between the holding component and the mounting component where the mounting component is not integrated with the head part.

Advantage of the Invention

According to this disclosure, ignition coil 30 is supported at a nodal point or at its neighborhood in the internal combustion engine. Therefore, vibration force of head part 32 can be reduced compared with the conventional ignition coil fixed to cylinder head 21, and the vibration force of amplification element 35 is thereby reduced. This reduces the malfunction of amplification element 35 due to the vibration of ignition coil 30. The moderate gap between ignition coil 30 and a cylinder head reduces the thermal influence.

BRIEF DESCRIPTION OF THE DRAWINGS

FIG. 1 illustrates an outline structure of an internal combustion engine according to the first embodiment.

FIG. 2 (*a*) illustrates an outline structure of the head part side of the ignition coil according to the second embodiment. FIG. 2 (*b*) illustrates an oscillation system including a dynamic damper.

FIG. 3 (*a*) illustrates an outline structure of the head part side of the ignition coil according to the third embodiment. FIG. 3 (*b*) illustrates an outline structure of the head part side of the ignition coil of the modified example according to the third embodiment.

FIG. 4 (*a*) illustrates an outline structure of the head part side of the ignition coil according to the fourth embodiment.

FIG. 4 (*b*) illustrates an outline structure of the head part side of the ignition coil of the modified example according to the fourth embodiment. FIG. 4 (*c*) illustrates an outline structure of the head part side of the ignition coil of the second modified example according to the fourth embodiment.

FIG. 5 illustrates an outline structure of the head part side of the ignition coil according to the fifth embodiment.

FIG. 6 illustrates an outline structure of the head part side of the ignition coil according to the other embodiment.

DETAILED DESCRIPTION

In the following, a detailed description will be given by an embodiment of the present invention with reference to the accompanying drawings. It should be noted that the following embodiments are merely preferable examples, and do not limit the scope of the present invention, applied field thereof, or application thereof.

First Embodiment

Internal combustion engine 20 equipped with ignition coil 30 (coil assy) is discussed hereafter with reference to the drawings. Internal combustion engine 20 is an example of the present invention.

Internal Combustion Engine

Internal combustion engine 20 is a reciprocating type internal combustion engine as shown in FIG. 1. Internal combustion engine 20 equips the internal combustion engine main body 28 which includes cylinder head 21, cylinder 22, and piston 23. Piston 23 is formed inside cylinder 22 so as to reciprocate freely. Cylinder head 21 cylinder 22 and piston 23 form combustion chamber 24. When piston 23 reciprocates in the axial direction of cylinder 22 inside cylinder 22, a connecting rod (not illustrated) converts the reciprocation of piston 23 to a rotational movement.

Plughole 25 is formed in cylinder head 21 so as to penetrate cylinder head 21 straightly. Plughole 25 is a penetration hole having a circular section. Spark plug 26 is fixed to cylinder head 21 in the combustion chamber 24 side of plughole 25. Ignition coil 30 of pillar shaped shape is attached to spark plug 26. Cylinder head 21 forms therein the inlet port and exhaust port (not illustrated) that opens toward combustion chamber 24. An intake valve is formed in the inlet port. An exhaust valve is formed in the exhaust port. Further, an injector is provided in the combustion chamber or the inlet port. Here, internal combustion engine 20 is not limited to a reciprocating type internal combustion engine.

Ignition Coil

Ignition coil 30 is so called a "stick coil". As shown in FIG. 1, ignition coil 30 equips cylindrical main body part 31, head part 32 located in one end side of main body part 31, and attaching part 33 located in other end side of main body part 31. Main body part 31, head part 32, and attaching part 33 are integrated. Ignition coil 30 shall not be limited to the stick coil and a coil part, which will be discussed later, can be provided on head part 32.

Main body part 31 accommodates a coil part (transformer) which includes a primary coil, a secondary coil, and an iron core inside the case of body part 31. The case of body part 31 is formed cylindrical. A High voltage terminal connected to the output side of the coil part is provided in the attaching part 33 side of body part 31.

Head part 32 equips an igniter (a switching circuit that includes a transistor) and microwave amplification element 35 (for example, an IC chip made of semiconductor device). Microwave amplification element 35 occupies a large area since this is located in addition to a transistor of the igniter. Igniter and amplification element 35 are mounted on substrate 36 (mounting component) that is fixed inside the case of head part 32. Amplification element 35 is integrated with substrate 36. Head part 32 is provided with a first input terminal for ignition signal, a second input terminal for battery connection, and a third input terminal for microwave. Microwave oscillation element, e.g. crystal oscillator, can be provided on head part 32 for generating microwave. Amplification element 35 and microwave oscillation element correspond to electromagnetic wave elements.

Attaching part 33 is formed in an approximate cylindrical shape. Attaching part 33 is formed of an elastic component such as rubber. Spark plug 26 is inserted inside Attaching part 33.

Magnetic energy is stored in ignition coil 30 by magnetization of an iron core when the current from a battery flows into a primary coil side of the coil part via a second input terminal. The primary current is intercepted by the switching of the igniter when an ignition signal is inputted from the first input terminal in this state because the voltage occurs in the primary coil and the magnetic field around the iron core changes. As a result, a high-voltage pulse is generated in a secondary coil, and the high-voltage pulse is outputted to spark plug 26 from a high-voltage terminal. When microwaves, e.g. microwave pulses are inputted from a third input terminal, the microwaves are amplified by amplification element 35. A mixing circuit for mixing the high-voltage pulse and microwaves is provided in main body part 31 or head part 32 of ignition coil 30. Microwaves outputted from amplification element 35 are outputted to spark plug 26 via the mixing circuit. When the ignition signal and the microwaves are inputted into ignition coil 30 almost simultaneously, the high-voltage pulse and the microwaves are outputted to spark plug 26 from ignition coil 30 almost simultaneously. Small plasma is generated in a spark gap of spark plug 26 using spark discharge of high-voltage pulse. This plasma is enlarged by microwaves and microwave plasma is thereby generated.

Ignition coil 30 is attached to spark plug 26 by inserting into plughole 25 from attaching part 33 side and by inserting an input terminal side of spark plug 26 to attaching part 33. The high-voltage terminal is forced to the input terminal of spark plug 26 by spring component of main body part 31 in the attachment state where ignition coil 30 is attached to spark plug 26. The entire head part 32 is located in the outside of plughole 25. Clearances are provided between the wall surface of plughole 25 and peripheral side of main body part 31, and between the wall surface of plughole 25 and peripheral side of attaching part 33. When internal combustion engine 20 vibrates during an operation, the vibration of internal combustion engine 20 is transmitted to ignition coil 30 via attaching part 33. Clearance or crevice can be provided between attaching part 33 and spark plug 26 in the attaching state.

The amplitude of vibration becomes larger in the direction perpendicular to the axis of main body part 31 because ignition coil 30 is pillar shaped (beam-like shape). In case of a conventional ignition coil, the ignition coil is screwed to upper part of cylinder head 21 in the head part position together with the engine cover. The ignition coil is supported to cylinder head 21 by the head part and the attaching part. Therefore, the head part vibrates integrally with cylinder head 21 because the vibration of cylinder head 21 easily transmits to the head part, and a strong vibration acts to the amplification element. As a result, a voltage signal due to deformation of vibration may arise in the amplification element, which is a semiconductor device, and the amplification element may cause malfunction. Further, the amplification element may easily break down.

On the contrary, internal combustion engine 20 of this embodiment has a support structure that reduces the vibration force of ignition coil 30 acting to amplification element 35. The support structure comprises first support component 41 and second support component 42 that supports ignition coil 30 at nodal point 50 (node of primary basic mode) of the vibration in ignition coil 30, where the vibration is flexural vibration in the direction perpendicular to the axis of body part 31 (this direction will be referred to "normal direction" hereafter) when ignition coil 30 vibrates accompanied by the vibration of internal combustion engine 20. Each support components 41 and 42 supports main body part 31 of ignition coil 30 at nodal point 50 toward the wall surface of plughole 25. The support structure does not support ignition coil 30 using first support component 41 and second support component 42 at the position that is closer to head part 32 compared with first support component 41.

Resonance frequency and vibration mode of ignition coil 30 are determined by mass and flexural rigidity of each portions. The node position (nodal point 50) and belly position of the vibrating ignition coil 30 is determined when the vibration mode is determined. Nodal point 50 is a position inherent to ignition coil 30. Nodal point 50 of ignition coil 30 can be recognized using an analysis such as finite element method. FIG. 1 illustrates, in dashed lines, first line indicating amplitude in the horizontal direction, i.e. normal direction in the vertical position of ignition coil 30, and a second line indicating position where the amplitude becomes zero in the horizontal direction. Nodal point 50 is a position where the first and the second lines intersects in the vertical direction of ignition coil 30, and the amplitude in the horizontal direction becomes zero in nodal point 50.

In this embodiment, each support components 41 and 42 are arranged on nodal point 50 which is acquired analytically beforehand. Each support components 41 and 42 can be fixed to the peripheral side of main body part 31 of ignition coil 30, or can be fixed to wall surface of plughole 25. Each support components 41 and 42 can be the protrusions that project from the peripheral surface of main body part 31 or wall surface of plughole 25. In this embodiment, each support components 41 and 42 are located on nodal point 50; however, each support components 41 and 42 can be located near nodal point 50.

Each support components 41 and 42 are elastic components, e.g. rubber component. Ignition coil 30 is supported elastically by each support components 41 and 42. Each support component 41 and 42 is formed in ring like shape. In this embodiment, support components 41 and 42 are provided one by one for each nodal point 50; however, multiple support components can be provided corresponding to each nodal point 50.

Non-elastic material such as steel component can be used as each support components 41 and 42. In this case, ignition coil 30 is supported by each support components 41 and 42 when the portion contacting with each support components 41 and 42 in the casing of ignition coil 30 is an elastic material.

Advantage of the Present Embodiment

In this embodiment, ignition coil 30 is supported, besides spark plug 26, by support components 41 and 42 located in nodal point 50. Therefore, vibration force of head part 32 can be reduced compared with the conventional ignition coil where head part 32 is fixed to cylinder head 21, and can reduce the vibration occurring in amplification element 35. Therefore, malfunction of amplification element 35 resulting from vibration of ignition coil 30 can be controlled. Further, the thermal influence can be reduced also since a moderate clearance (gap) is provided between ignition coil 30 and the cylinder head.

Second Embodiment

In the present embodiment, vibration in the head part 32 of ignition coil 30 is reduced using dynamic damper 60. Hereinafter the points distinct from the first embodiment will be discussed.

As shown in FIG. 2 (*a*), ignition coil 30 is equipped with dynamic damper 60. Dynamic damper 60 includes small mass part 61 (weight) which functions as a secondary oscillating system, where a portion 65 (large mass part, this portion is the entirety of ignition coil 30 excluding dynamic damper 60), and elastic component 62 such as rubber components that connects small mass part 61 to head part 32 as shown in FIG. 2 (*b*). The mass (modal mass) of small mass part 61 is smaller than the mass (modal mass) of large mass part 65. The mass of small mass part 61 and spring constant k of elastic component 62 of dynamic damper 60 are determined so that the resonance frequency (natural frequency) of the system consisting small mass part 61 and elastic component 62 divides the total resonance of large mass part 65. In FIG. 2 (*b*), K indicates a spring constant of large mass part 65.

In the example of FIG. 2 (*a*), small mass part 61 is made of steel materials and elastic component 62 is made of rubber material. Elastic component 62 is fixed on the upper surface of a case of head part 32, and small mass part 61 is fixed on the upper surface of elastic component 62. Dynamic damper 60 is formed so that the small mass part 61 vibrates in the opposite phase direction of the vibration of internal combustion engine 20 and ignition coil 30.

Advantage of this Embodiment

According to the present embodiment, dynamic damper 60 is attached to head part 32 and dynamic damper 60 can absorb the vibration energy. This reduces the vibration of head part 32, which is a portion of large mass part 65, and the vibration of amplification element 35 is thereby reduced. Therefore, malfunction of amplification element 35 resulting from the vibration of ignition coil 30 can be reduced. Dynamic damper 60 can be attached to a belly position of vibration in the characteristic vibration mode of ignition coil 30, or can be attached to attaching part 33.

Third Embodiment

In this embodiment, vibration acting on amplification element 35 is reduced using a floating structure that softy supports substrate 36 so that the integrity of amplification element 35 and substrate 36 against head part 32 is reduced. Hereafter, the points distinct from the first embodiment mil be discussed.

As shown in FIG. 3 (*a*), ignition coil 30 has support component 70 as a floating structure. Support component 70 is a pliable sheet material, for example. Support component 70 has rigidity lower than substrate 36.

Support component 70 is fixed on component installation surface 32*a* inside the case of head part 32. Substrate 36 for mounting amplification element 35 is fixed on the upper surface of support component 70.

Characteristic vibration frequency f1 in the normal direction of resonance body consisting of substrate 36 and amplification element 35 is determined based on spring constant of support component 70 and total mass of substrate 36 and amplification element 35. In this embodiment, the spring constant of support component 70 and the total mass of substrate 36 and amplification element 35 are determined so that characteristic vibration frequency f1 becomes lower than frequency N, where N is frequency of fundamental degree vibration in the normal direction of internal combustion engine 20. For example, the fundamental degree will be the second degree in case of four cylinders.

Advantage of the Present Embodiment

According to the present embodiment, transmission of vibration from head part 32 to substrate 36 is reduced because support component 70 of floating structure is intervened between substrate 36 and component installation surface 32*a*. This reduces the vibration of amplification element 35. Malfunction of amplification element 35 resulting from vibration of ignition coil 30 can thereby be reduced.

In the present embodiment, substrate 36 hardly deforms compared to a case where a portion of substrate 36 is adhered to support component 70 because the entire back surface of substrate 36 is adhered to support component 70. The deformation of amplification element 35 originated by vibration is thereby reduced.

Modification of the Present Embodiment

In this modification, multiple support components 71 are formed as a floating structure as shown in FIG. 3 (*b*). Substrate 36 is supported by multiple support components 71. One end of each support components 71 are fixed to component installation surface 32*a*, and the other ends are fixed to substrate 36. Multiple support components 71 support substrate 36 in the four corners of substrate 36. Support component 71 can be a tiny rubber ball or bonding material. According to this modification, vibration of amplification element 35 can be further reduced because the flexibility between component installation surface 32*a* and substrate 36 is increased.

Fourth Embodiment

In this embodiment, vibration force acting on dumping material 80 is reduced using dumping material 80 that can attenuate the vibration. Hereafter, the points distinct from the first embodiment will be discussed.

As shown in FIG. 4 (*a*), ignition coil 30 equips dumping material 80. Dumping material 80 is a solid material such as a pliable sheet material having small rigidity (elastic modulus) compared to substrate 36. Dumping material 80 is fixed to component installation surface 32*a* inside the case of head part 32. Substrate 36 for mounting amplification element 35 is fixed to the upper surface of dumping material 80.

Advantage of this Embodiment

In this embodiment, substrate 36 is supported by head part 32 through dumping material 80. The vibration of amplification element 35 on substrate 36 is thereby reduced, and malfunction of amplification element 35 resulting from vibration of ignition coil 30 is can be reduced. Further, deformation of amplification element 35 due to vibration can be reduced because the whole back surface of substrate 36 is adhered to dumping material 80 in this embodiment.

Modification 1 of the Present Embodiment

In the modification 1, substrate 36 is supported by multiple dumping materials 81 as shown in FIG. 4 (*b*). One ends of each dumping materials 81 are fixed to component installation surface 32*a* and the other ends are fixed to substrate 36. For example, multiple dumping materials 81 support substrate 36 in the four corners of substrate 36. According to modification 1, vibration of amplification element 35 can further be reduced because the pliability between component installation surface 32*a* and substrate 36 is improved.

Modification 2 of the Present Embodiment

In modification 2, dumping material 83 is made of fluid (inactive gas, or liquids such as oil). As shown in FIG. 4 (*c*), ignition coil 30 equips auxiliary component 85 of rectangular piped shape fixed to component installation surface 32*a*. Dumping material 83 is enclosed between substrate 36 in auxiliary component 85 and component installation surface 32*a*. A seal material can be provided in the circumference of substrate 36.

Fifth Embodiment

In this embodiment, vibration acting on amplification element 35 is reduced by supporting substrate 36 using frictional force only. Hereafter, the points distinct from the first embodiment will be discussed.

As shown in FIG. 5, ignition coil 30 equips a support structure including holding component 91 that holds substrate 36 using a frictional force in the area contacting with substrate 36. The support structure supports substrate 36 using frictional force between holding component 91 and substrate 36 without integrating substrate 36 with head part 32.

Holding component 91 is a component such as rubber, and is different from substrate 36. Holding component 91 equips a rectangle pipe shaped main body part 91*a* and stopper 91*b* that projects inside from one end side of main body part 91. The other end side of main body part 91*a* is fixed to component installation surface 32*a*. The inner circumference of main body part 91*a* is slightly smaller than the periphery of rectangular substrate 36. Substrate 36 is inserted in the inside of main body part 91*a*. Here, main body part 91*a* presses substrate 36 inside using stability of main body part 91*a*. Substrate is held by frictional force between main body part 91*a* and contacting area of substrate 36. Stopper 91*b* prevents substrate 36 from slipping out from main body part 91*a*. The number of holding component 91 is one in this embodiment; however, substrate 36 can be supported by multiple holding component 91 can be used.

The support structure further equips support component 92. Support component 92 is a component different from substrate 36 and is fixed to component installation surface 32*a*. The movement of substrate 36 toward the bottom side (in FIG. 5) is thereby inhibited using support component 92. The support structure does not need an additional support component 92. The fluid can be provided between substrate 36 and component installation surface 32*a* instead of support component 92.

Advantage of this Embodiment

In this embodiment, substrate 36 is not integrated with head part 32 and is supported using frictional force only. The vibration transmitting to substrate 36 from head part 32 can be reduced compared to the case when substrate 36 is integrated with head part 32. The malfunction of amplification element 35 resulting from vibration of ignition coil 30 can thereby be reduced.

Other Embodiment

The following embodiment can be contemplated.

In the above embodiment, electromagnetic wave element (amplification element 35) is provided inside an identical case with the igniter; however, electromagnetic wave element 35 can be provided inside a case that is different from head part 32 as shown in FIG. 6. Head part 32 equips first case 111 for accommodating an igniter and second case 112 for accommodating electromagnetic wave element 35. Second case 112 is fixed to first case 111 using screw, for example.

The above mentioned first embodiment can be combined with the second, third, fourth, or fifth embodiment.

INDUSTRIAL APPLICABILITY

The present disclosure is applicable to an internal combustion engine that includes an ignition coil equipped with an electromagnetic wave element which outputs electromagnetic waves.

EXPLANATION OF REFERENCE NUMERALS

20 Internal combustion engine
25 Plughole
26 Spark plug
28 Internal combustion engine main body
30 Ignition coil
31 Main body part
32 Head part
33 Attaching part
35 Amplification element (electromagnetic wave element)
36 Substrate (mounting component)
41 First support component
42 Second support component
50 Nodal point

The invention claimed is:

1. An internal combustion engine including an internal combustion engine main body forming a plughole therein; and a pillar shaped ignition coil to be inserted in the plughole;

wherein an electromagnetic wave element is provided on a head part of the one end side of the ignition coil for outputting electromagnetic waves to be emitted to the combustion chamber of the internal combustion engine main body; and the internal combustion engine comprises a plurality of supporting components that support the ignition coil at a nodal point of the characteristic vibration mode of vibration that occurs in the ignition coil accompanied by the vibration of the internal combustion engine main body when an attaching part in the other end of the ignition coil is attached to the ignition plug positioned in the combustion chamber side of the plughole.

2. The internal combustion engine as claimed in claim 1, wherein the ignition coil forms therein a dynamic damper in the head part or in the attaching part.

3. The internal combustion engine as claimed in claim 2, wherein the dynamic damper comprises a spring component attached to the head part, and a mass object connected to the head part through the spring component, and the mass object is laminated on the spring component.

4. The internal combustion engine as claimed in claim 1, wherein the ignition coil comprises a mounting component for mounting an electromagnetic wave element, and a dumping material made of fluid or solid material of low rigidity compared to the mounting component, wherein the dumping material is provided between the mounting component and an installation surface for installing on the mounting component in the head part.

5. The internal combustion engine as claimed in claim 4, wherein, the dumping material is a solid material of low rigidity compared to the mounting component and the spring constant of the dumping material is set so that the natural frequencies of the mounting component and the electromagnetic wave element becomes smaller than the fundamental order vibration frequency of the internal combustion engine main body.

6. The internal combustion engine as claimed in claim 1, wherein, the ignition coil includes a mounting component that mounts the electromagnetic wave element, and a holding component that holds the mounting component using a frictional force at the domain contacting with the mounting component, wherein the holding component is a component different from the mounting component; and the mounting component is held using a frictional force between the holding component and the mounting component where the mounting component is not integrated with the head part.

7. An ignition coil of pillar shaped inserted in a plughole of an internal combustion engine, wherein an attaching part of the one end side is attached to the spark plug positioned in the combustion chamber side of the plughole, the ignition coil comprising:

an electromagnetic wave element that outputs the electromagnetic waves to be emitted to the combustion chamber is provided on the head part of the other end side of the ignition coil, and a dynamic damper attached to the head part or the attaching part, wherein the dynamic damper includes a spring component attached to the head part, and a mass object connected to the head part via the spring component, and the mass object is laminated on the spring component.

8. An ignition coil of pillar shaped inserted in the plughole of an internal combustion engine, where an attaching part of one end side is attached to the spark plug positioned in the combustion chamber side of the plughole, comprising:

an electromagnetic wave element that outputs the electromagnetic waves to be emitted to the combustion chamber is provided on the head part of the other end side of the ignition coil, and;

a mounting component that mounts the electromagnetic wave element; and a dumping material made of fluid or solid material of low rigidity compared to the mounting component, wherein the dumping material is provided in the head part between the mounting component and an installation surface for installing the mounting component.

9. The internal combustion engine as claimed in claim 8, wherein, the dumping material is a solid material of low rigidity compared to the mounting component and the spring constant of the dumping material is set so that the natural frequencies of the mounting component and the electromagnetic wave element becomes smaller than the fundamental order vibration frequency of the internal combustion engine main body.

10. An ignition coil of pillar shaped inserted in a plughole of an internal combustion engine, where an attaching part of the one end side is attached to the spark plug positioned in the combustion chamber side of the plughole, comprising:

an electromagnetic wave element that outputs the electromagnetic waves to be emitted to the combustion chamber is provided on the head part of the other end side of the ignition coil;

a mounting component that mounts the electromagnetic wave element;

a holding component that holds the mounting component using a frictional force at the domain contacting with the mounting component, wherein the holding component is a component different from the mounting component;

wherein the mounting component is held using a frictional force between the holding component and the mounting component where the mounting component is not integrated with the head part.

* * * * *